US011933582B1

(12) United States Patent
De La Cruz-Peterson

(10) Patent No.: US 11,933,582 B1
(45) Date of Patent: Mar. 19, 2024

(54) HOLSTER INSERT ASSEMBLY

(71) Applicant: Ryan De La Cruz-Peterson, Folsom, CA (US)

(72) Inventor: Ryan De La Cruz-Peterson, Folsom, CA (US)

( * ) Notice: Subject to any disclaimer, the term of this patent is extended or adjusted under 35 U.S.C. 154(b) by 169 days.

(21) Appl. No.: 17/707,715

(22) Filed: Mar. 29, 2022

(51) Int. Cl.
*F41C 33/02* (2006.01)
*F41G 11/00* (2006.01)

(52) U.S. Cl.
CPC ..... *F41C 33/0254* (2013.01); *F41G 11/003* (2013.01); *F41C 33/0263* (2013.01)

(58) Field of Classification Search
CPC .. F41C 33/0254; F41C 33/02; F41C 33/0209; F41C 33/04
USPC ..... 224/243, 911, 912
See application file for complete search history.

(56) References Cited

U.S. PATENT DOCUMENTS 5,215,238 A * 6/1993 Baruch ..... F41C 33/0263 224/244
7,644,845 B2 * 1/2010 Lowe ..... F41C 33/0209 224/912
7,954,971 B1 * 6/2011 Kincaid ..... F41G 11/004 42/114
8,690,032 B2 * 4/2014 Baumann ..... F41C 33/0263 224/238
9,297,612 B2 * 3/2016 Schmadeka ..... F41C 33/0209

* cited by examiner

*Primary Examiner* — Justin M Larson
(74) *Attorney, Agent, or Firm* — Plager Schack LLP; Mark H. Plager; Michael J. O'Brien

(57) ABSTRACT

A firearm assembly is configured to have a consistent ride height. The firearm assembly has a holster insert further having a lower opening surrounded by a light rest. A fastener opening is arranged through the holster insert. A holster is joined to the holster insert with a screw and nut through the fastener opening and locating peg. A light is arranged in the holster and immediately adjacent to the light rest. A firearm has an accessory rail which joins the light to the firearm. The light against the light rest holds the firearm at a consistent ride height in the holster.

6 Claims, 3 Drawing Sheets

HOLSTER INSERT ASSEMBLY

BACKGROUND

The embodiments herein relate generally to firearm accessories.

Prior to embodiments of the disclosed invention, holster inserts caused improper ride height that caused safety issues related to firearm controls such as the magazine release being unintentionally pressed. Additionally, holster inserts did not allow for debris to pass through the holster body. Embodiments of the disclosed invention solve these problems.

SUMMARY

A firearm assembly is configured to have a consistent ride height. The firearm assembly has a holster insert further having a lower opening surrounded by a light rest. A fastener opening is arranged through the holster insert. A holster is joined to the holster insert with a screw and nut through the fastener opening, as well as with a locating peg. A light is arranged in the holster and immediately adjacent to the light rest. A firearm has an accessory rail which joins the light to the firearm. The light against the light rest holds the firearm at a consistent ride height in the holster.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
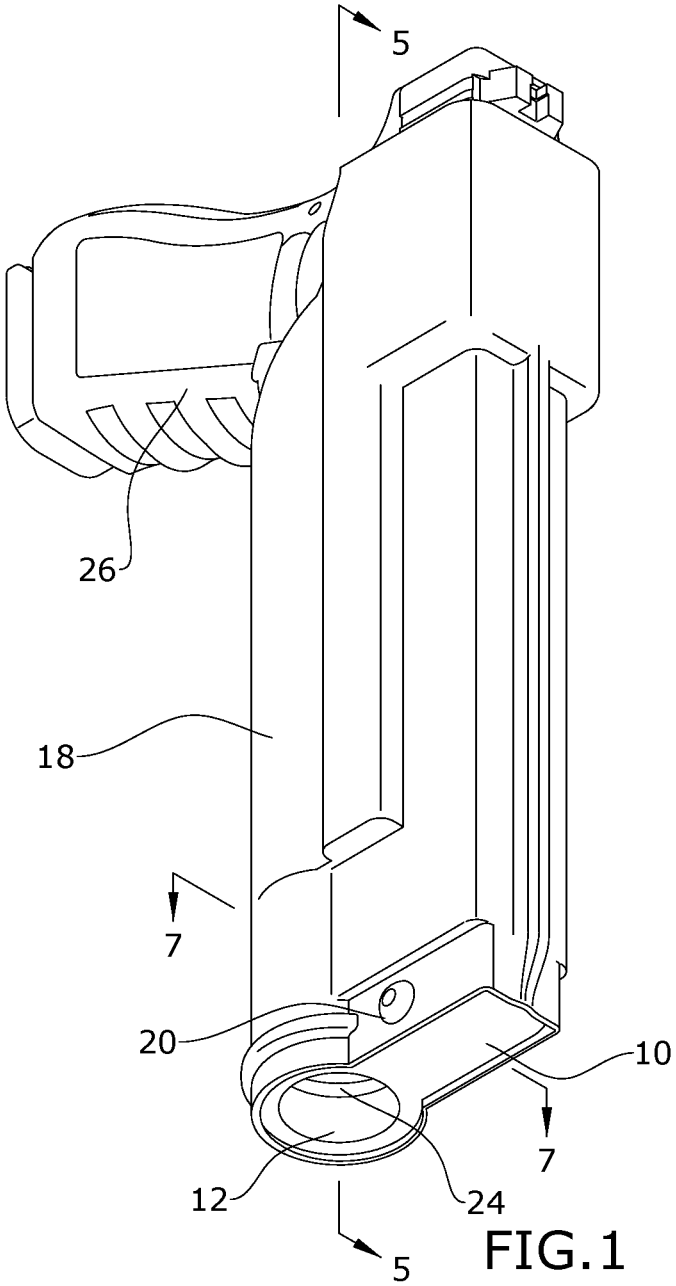
FIG. 1 shows a perspective view of one embodiment of the present invention.
Figure 2:
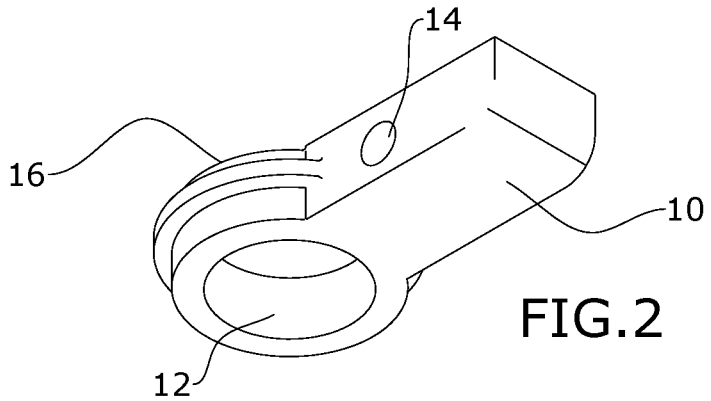
FIG. 2 shows a perspective view of one embodiment of the present invention.
Figure 3:
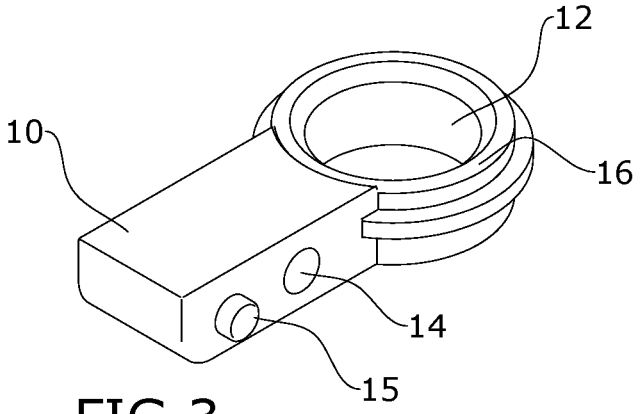
FIG. 3 shows a perspective view of one embodiment of the present invention.
Figure 4:
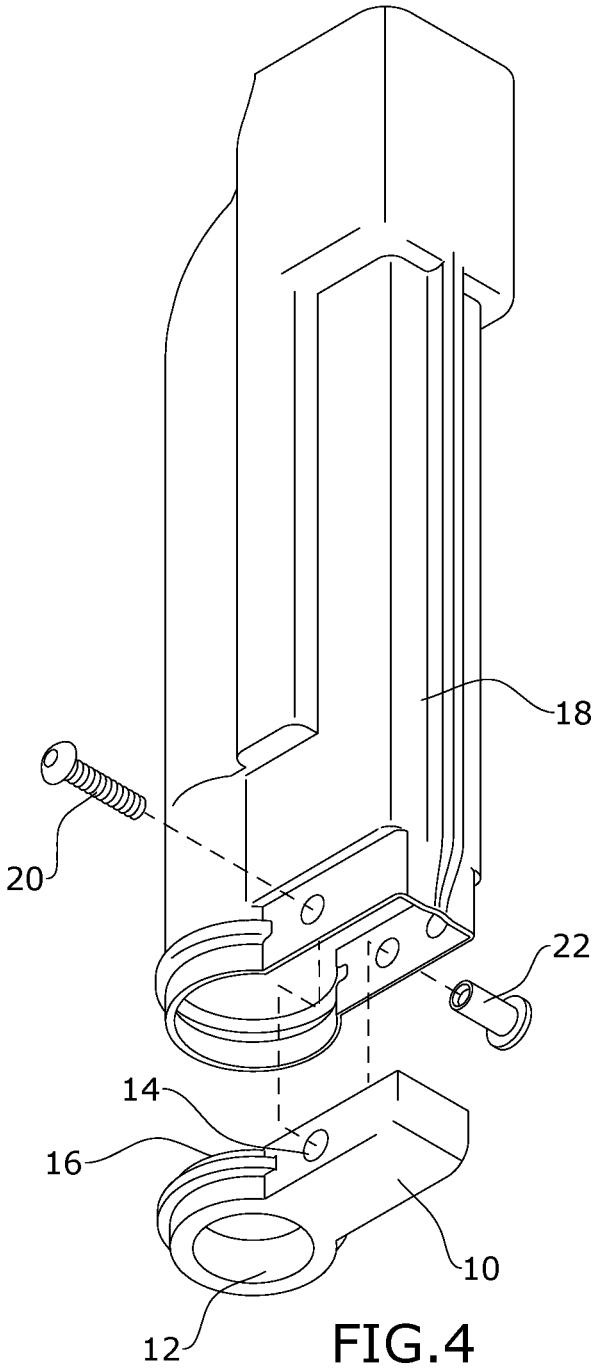
FIG. 4 shows an exploded view of one embodiment of the present invention.
Figure 5:
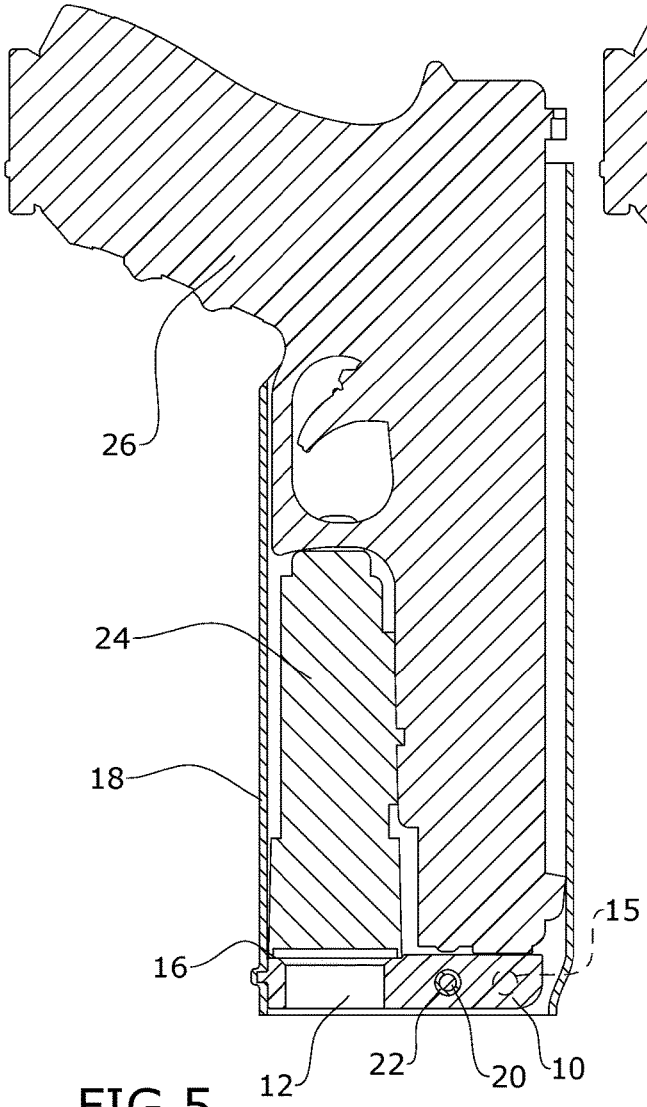
FIG. 5 shows a section view of one embodiment of the present invention taken along line 5-5 in FIG. 1.
Figure 6:
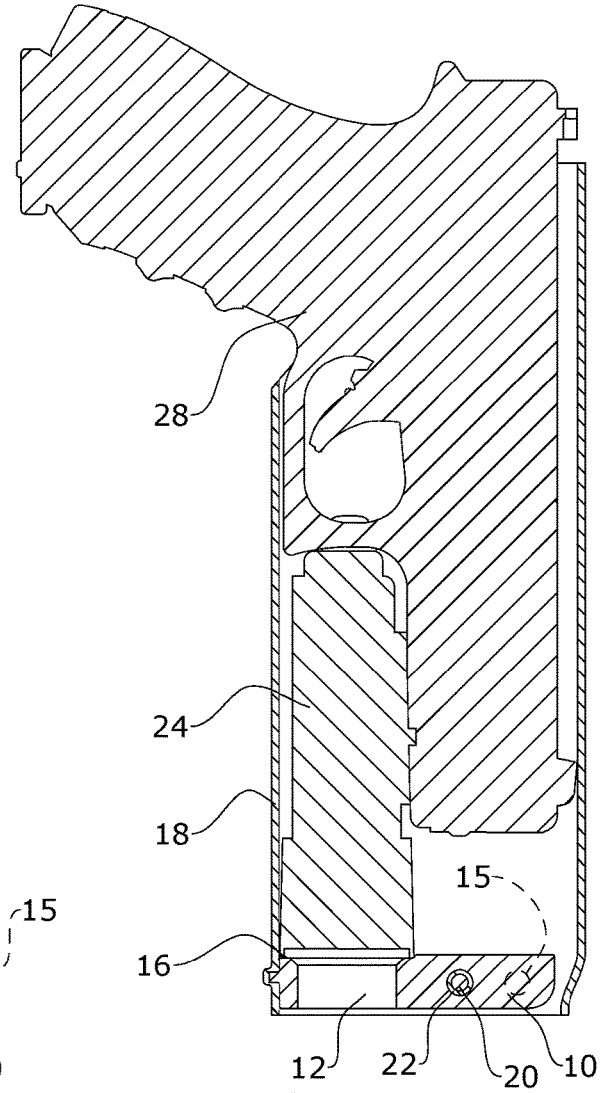
FIG. 6 shows a section view of one embodiment of the present invention with a shorter firearm having the same ride height.
Figure 7:
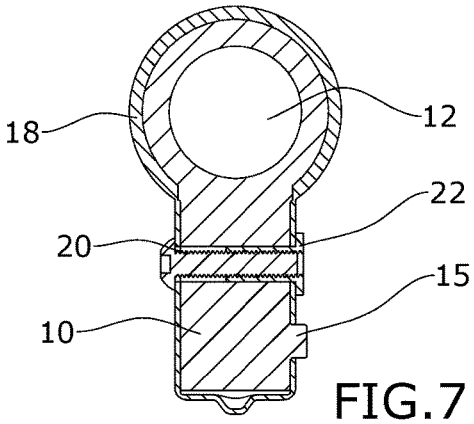
FIG. 7 shows a section view of one embodiment of the present invention taken along line 7-7 in FIG. 1.

By way of example, and referring to FIGS. 1-7, one embodiment of a firearm assembly is configured to have a consistent ride height. The firearm assembly has a holster insert 10 further having a lower opening 12 surrounded by a light rest 16. A fastener opening 14 is arranged through the holster insert 10. A holster 18 is joined to the holster insert 10 with a screw 20 and nut 22 through the fastener opening 14 and locating peg 15 to align the holster insert 10 within the holster 18. A light 24 is arranged in the holster 18 and immediately adjacent to the light rest 16. A firearm has an accessory rail which joins the light 24 to the firearm 26 or 28. The light 24 against the light rest 16 holds the firearm 26 or 28 at a consistent ride height in the holster 18.

The light 24 against the light rest 16 can hold a short firearm 28 at the same ride height as a long firearm 26.

The accessory rail can be a picatinny rail, a 1913 rail, or another attachment rail.

As used in this application, the term "ride height" refers to the amount of the trigger guard that is housed in the holster and the location of where the grip of the firearm sits in relation to the holster body. This is more qualitative than quantitative. Too high ride height refers to too much of the trigger guard extending out of the holster and the firearm not locking properly into the holster. Too low of ride height refers to nearly all of the trigger guard being housed within the holster and the grip of the firearm sitting too low in the holster, not allowing for a proper grip to be made when drawing the firearm and also allowing the firearm controls to be activated by the holster body. The first problem solved here deals with the proper ride height of the firearm ensuring a proper grip can be made when drawing the firearm from the holster regardless of the size of the firearm. The second problem solved here deals with the firearm controls being activated by the holster body, like the magazine release being housed in the holster and then activated by the holster body.

The ride height is sized to prevent the holster from interfering with firearm controls and to allow for a proper grip and draw to be made when accessing the firearm. The ride height also ensures the proper function of the holster locking and retaining the firearm. The holster has a lower opening that is sized to permit debris to fall through the bottom opening of the holster.

As used in this application, the term "a" or "an" means "at least one" or "one or more."

As used in this application, the term "about" or "approximately" refers to a range of values within plus or minus 10% of the specified number.

As used in this application, the term "substantially" means that the actual value is within about 10% of the actual desired value, particularly within about 5% of the actual desired value and especially within about 1% of the actual desired value of any variable, element or limit set forth herein.

All references throughout this application, for example patent documents including issued or granted patents or equivalents, patent application publications, and non-patent literature documents or other source material, are hereby incorporated by reference herein in their entireties, as though individually incorporated by reference, to the extent each reference is at least partially not inconsistent with the disclosure in the present application (for example, a reference that is partially inconsistent is incorporated by reference except for the partially inconsistent portion of the reference).

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A firearm assembly, configured to have a consistent ride height; the firearm assembly comprising:

a holster insert further comprising a lower opening surrounded by a light rest;

a fastener opening arranged through the holster insert;

a holster, joined to the holster insert with a screw and nut through the fastener opening;

a light arranged in the holster and immediately adjacent to the light rest;

a firearm further comprising an accessory rail which joins the light to the firearm;

wherein the light against the light rest holds the firearm at a consistent ride height in the holster.

2. The firearm assembly of claim 1, further comprising a locating peg, joined to the holster insert and the holster.

3. The firearm assembly of claim 2, wherein the accessory rail is a picatinny rail.

4. The firearm assembly of claim 2, wherein the accessory rail is a 1913 rail.

5. The firearm assembly of claim 2, wherein the ride height is sized to prevent the holster from interfering with firearm controls.

6. The firearm assembly of claim 2, wherein the lower opening is sized to permit debris to fall through a bottom opening of the holster.

* * * * *